US005988988A

United States Patent [19]

Tokumasu

[11] Patent Number: 5,988,988

[45] Date of Patent: Nov. 23, 1999

[54] CAPACITY CONTROL VALVE DEVICE FOR VARIABLE CAPACITY SWASH PLATE COMPRESSORS

[75] Inventor: Hiroshi Tokumasu, Higashimatsuyama, Japan

[73] Assignee: Zexel Corporation, Tokyo, Japan

[21] Appl. No.: 08/921,652

[22] Filed: Aug. 26, 1997

[30] Foreign Application Priority Data

Sep. 3, 1996 [JP] Japan ..... 8-252432
Feb. 10, 1997 [JP] Japan ..... 9-041608

[51] Int. Cl.[6] ..... F04B 1/26; F16K 31/12

[52] U.S. Cl. ..... 417/222.2; 137/489.5

[58] Field of Search ..... 417/222.2; 137/489.5, 137/102, 513.5

[56] References Cited

U.S. PATENT DOCUMENTS

| | | | |
|---|---|---|---|
| 4,688,997 | 8/1987 | Suzuki et al. | 417/222 |
| 4,890,458 | 1/1990 | Kobayashi et al. | 62/204 |
| 5,205,718 | 4/1993 | Fujisawa et al. | 417/222.2 |
| 5,242,274 | 9/1993 | Inoue | 417/222.2 |
| 5,620,310 | 4/1997 | Takenaka et al. | 417/222.2 |
| 5,702,235 | 12/1997 | Hirota et al. | 417/222.2 |
| 5,785,502 | 7/1998 | Ota et al. | 417/222.2 |
| 5,836,748 | 11/1998 | Kawaguchi et al. | 417/222.2 |

*Primary Examiner*—Charles G. Freay
*Assistant Examiner*—Paul Ratcliffe
*Attorney, Agent, or Firm*—Frishauf, Holtz, Goodman, Langer & Chick, P.C.

[57] ABSTRACT

A capacity control valve device for a variable capacity swash plate compressor which includes at least one piston, a suction port, a suction chamber, and a refrigerant inlet passage communicating the suction port with the suction chamber, in which each piston has its stroke changed to control delivery quantity of the compressor. The control valve device is arranged at an intermediate portion of the refrigerant inlet passage, for controlling differential pressure between the suction port and the suction chamber. The control valve device includes a valve element, a first urging member for urging the valve element in a valve-opening direction, an accumulator for accumulating high-pressure refrigerant gas having higher pressure than pressure within the suction chamber to build up pressure therein for urging the valve element in a valve-closing direction, a high-pressure passage for introducing the high-pressure refrigerant gas into the accumulator, and a pilot valve arranged at an intermediate portion of the high-pressure passage for controlling a flow rate of the high-pressure refrigerant gas into the accumulator in dependence on the pressure in the suction port. The pilot valve has a valve element, and a second urging member for urging the valve element in a valve-closing direction. The control valve device comprises a pressure control passage opened by the pilot valve for permitting the high-pressure refrigerant gas accumulated within the accumulator to escape, when the pilot valve operates in the valve-closing direction.

6 Claims, 5 Drawing Sheets

CAPACITY CONTROL VALVE DEVICE FOR VARIABLE CAPACITY SWASH PLATE COMPRESSORS

BACKGROUND OF THE INVENTION

1. Field of the Invention

This invention relates to a capacity control valve device for variable capacity swash plate compressors, and more particularly to a capacity control valve device of this kind, which changes the stroke of pistons of a variable capacity swash plate compressor to thereby control delivery quantity of the variable capacity swash plate compressor.

2. Description of the Prior Art

FIGS. 1 and 2 are conceptual views showing a conventional capacity control valve device of a variable capacity swash plate compressor. FIG. 1 shows the capacity control valve device in a state in which the valve opening of a main valve thereof is small, and FIG. 2 shows the capacity control valve device in a state in which the valve opening of the main valve is large.

The capacity control valve device is arranged within a rear head 103 of the variable capacity swash compressor. As shown in FIG. 1, the capacity control valve device is comprised of a main valve 130 having a valve element 131 and a spring 132 for urging the valve element 131 in a valve-opening direction (downward as viewed in FIG. 1), an accumulator 133 for accumulating high-pressure refrigerating gas therein to build up pressure for urging the valve element 131 in a valve-closing direction, a high-pressure passage 134 for introducing the high-pressure refrigerant gas from a discharge chamber 112 into the accumulator 133, a pilot valve 140 arranged at an intermediate portion of the high-pressure passage 134 for controlling a flow rate of the high-pressure refrigerant gas flowing into the accumulator 133 in dependence on pressure in a suction port 103*a*, the pilot valve having a valve element 135 and a spring 125 for urging the valve element 135 in a valve-closing direction (i.e. upward as viewed in FIG. 1), and a pressure control passage 131*a* formed through the valve element 131 for permitting the high-pressure refrigerant gas within the accumulator 133 to escape to a suction chamber 113.

The suction port 103*a* is constantly communicated with a crank case (not shown), and the pressure in the suction port 103*a* and pressure within the crank case are maintained equal to each other.

When thermal load on the compressor decreases to decrease the pressure Pe in the suction port 103*a*, the pilot valve 140 is opened, as shown in FIG. 1, to permit the high-pressure refrigerant gas to flow from the discharge chamber 112 into the accumulator 133 through the high-pressure passage 134. Part of the high-pressure refrigerant gas which has flowed into the accumulator 133 escapes to the suction chamber 113 via the pressure control passage 131*a* formed through the valve element 132. However, the flow rate of high-pressure refrigerant gas which escapes from the accumulator 133 is smaller than that of high-pressure refrigerant gas flowing therein, so that the pressure within the accumulator 133 builds up. Further, when the pressure Pe in the suction port 103*a* decreases, force urging the valve element 131 downward, i.e. in the valve-opening direction decreases, whereby the valve element 131 is moved upward i.e. in the valve-closing direction to reduce the valve opening of the main valve 130. The valve element 131 of the main valve 130 is thus moved in the valve-closing direction up to a position in which the pressure within the accumulator 133 and the sum of the pressure Pe in the suction port 103*a* and urging force Fp of the spring 125 become equal to each other.

The condition in which the pressure Pe in the suction port 103*a* is low (see FIG. 1) can be expressed as follows:

$$Pd \times Sd > Pe \times Se + Fp$$

where Pd: pressure within the discharge chamber, Sd: a pressure-receiving area of the valve element of the pilot valve on the Pd side, Pe: pressure in the suction port, Se: a pressure-receiving area of the valve element of the pilot valve on the Pe side, and Fp: urging force of the spring.

On the other hand, when the thermal load on the compressor increases to increase the pressure in the suction port 103*a*, the pilot valve 140 is closed, as shown in FIG. 2, to cut off the flow of the high-pressure refrigerant gas from the discharge chamber 112 to the accumulator 133, so that the pressure within the accumulator 133 is progressively reduced as the high-pressure refrigerant gas within the accumulator escapes to the suction chamber 113 through the pressure control passage 131*a* of the valve element 131. As a result, the valve element 131 of the main valve 130 is moved in the valve-opening direction (downward as viewed in FIG. 2) to increase the valve opening of the main valve 130, whereby the flow rate of refrigerant gas from the suction port 103*a* to the suction chamber 113 is increased.

The condition in which the pressure Pe in the suction port 103*a* is high (see FIG. 2) can be expressed as follows:

$$Pd \times Sd < Pe \times Se + Fp$$

As described above, according to the conventional capacity control valve device, when the pilot valve 140 opens, the high-pressure refrigerant gas flows from the discharge chamber 133 into the accumulator 112 through the high-pressure passage 134. However, since part of the high-pressure refrigerant gas flowing into the accumulator 133 escapes to the suction chamber 113 through the pressure control passage 131*a*, the pressure within the accumulator 133 rises slowly. Therefore, it takes a considerable time period before the valve element 131 of the main valve 130 is moved in the valve-closing direction to decrease the valve opening the main valve 130, which results in degraded response of the device.

Further, according to the above capacity control valve device, when the pilot valve 140 closes, the flow of high-pressure refrigerant gas from the discharge chamber 112 to the accumulator 133 is cut off, and the high-pressure refrigerant gas within the accumulator 133 escapes to the suction chamber 113 through the pressure control passage 131*a*, whereby the pressure within the accumulator 133 is reduced. However, the pressure within the accumulator 133 decreases slowly, and hence it takes a considerable time period before the valve element 131 is moved in the valve-opening direction to increase the valve opening of the main valve 130, which also results in degraded response of the device.

SUMMARY OF THE INVENTION

It is an object of the invention to provide a capacity control valve device for a variable capacity swash plate compressor, whose response is enhanced.

To attain the above object, the present invention provides a capacity control valve device for a variable capacity swash plate compressor including at least one piston, a suction port, a suction chamber, and a refrigerant inlet passage communicating the suction port with the suction chamber, in which each of the at least one piston has its stroke changed to control delivery quantity of the compressor, the capacity control valve device being arranged at an intermediate portion of the refrigerant inlet passage, for controlling differential pressure between pressure in the suction port and pressure within the suction chamber, the capacity control valve device including a valve element, a first urging member for urging the valve element in a valve-opening direction, an accumulator for accumulating high-pressure refrigerant gas having higher pressure than pressure within the suction chamber to build up pressure therein for urging the valve element in a valve-closing direction, a high-pressure passage for introducing the high-pressure refrigerant gas into the accumulator, and a pilot valve arranged at an intermediate portion of the high-pressure passage for controlling a flow rate of the high-pressure refrigerant gas into the accumulator in dependence on the pressure in the suction port, the pilot valve having a valve element, and a second urging member for urging the valve element of the pilot valve in a valve-closing direction.

The capacity control valve device is characterized by comprising a pressure control passage opened by the pilot valve for permitting the high-pressure refrigerant gas accumulated within the accumulator to escape to decrease the pressure within the accumulator, when the pilot valve operates in the valve-closing direction.

According to this capacity control valve device, there is provided the pressure control passage opened by the pilot valve when it operates in the valve-closing direction, for permitting the high-pressure refrigerant gas within the accumulator to escape to reduce the pressure within the accumulator. Therefore, when the compressor is under a low thermal load condition in which the pressure in the suction port decreases to cause the pilot valve to operate in the valve-opening direction, the high-pressure refrigerant gas, which flows into the accumulator via the high-pressure passage e.g. from a discharge chamber, does not escape to the suction chamber. As a result, the pressure within the accumulator promptly rises, so that the valve element of the capacity control valve device quickly moves in the valve-closing direction to decrease the valve opening of the capacity control valve device. That is, excellent response of the capacity control valve device is obtained. In other words, the valve element of the pressure control valve device promptly moves in the valve-closing direction to narrow the intermediate portion of the refrigerant inlet passage at which the valve element of the capacity control valve device is arranged, whereby the delivery quantity of the compressor is decreased at a faster rate than by the conventional capacity control valve device.

On the other hand, when the compressor is under a high thermal load condition in which the pressure in the suction port rises to cause the pilot valve to operate in the valve-closing direction, the flow of the high-pressure refrigerant gas from the discharge chamber to the accumulator is cut off and the high-pressure refrigerant gas within the accumulator escapes therefrom to the suction port through the pressure control passage opened by the pilot valve. In the present device, differently from the conventional one, the pressure control passage has a large cross-sectional area, so that the pressure within the accumulator promptly drops. Therefore, the valve element of the capacity control valve device quickly moves in the valve-opening direction. That is, excellent response of the capacity control valve device is obtained. In other words, the valve element promptly moves in the valve-opening direction to broaden the intermediate portion of the refrigerant inlet passage at which the valve element of the capacity control valve device is arranged, whereby the delivery quantity of the compressor is increased at a faster rate than by the conventional capacity control valve device.

Preferably, the valve element of the pilot valve has an indentation formed on a peripheral surface thereof in a manner extending in a direction of movement of the valve element of the pilot valve, the pressure control passage being formed by the indentation.

Preferably, the capacity control valve device includes a pilot passage communicating with the suction port, the pilot valve being fitted in a through hole formed through a wall separating the pilot passage from the high-pressure passage, and the pressure control passage opened by the pilot valve when the valve element of the pilot valve is moved in the valve-closing direction causes communication between the pilot passage and a portion of the high-pressure passage on the accumulator side with respect to the pilot valve.

More preferably, the second urging member is a spring interposed between the valve element of the pilot valve and a portion of the pilot passage, for urging the valve element of the pilot valve in the valve-closing direction.

For instance, the pilot valve is formed by a spool valve.

Alternatively, the pilot valve is formed by a ball valve, the ball valve having a spherical valve element, the pressure control passage being formed by the through hole which is opened by movement of the spherical valve element in the valve-closing direction.

According to the preferred embodiment of the invention, the ball valve is used as a pilot valve. Therefore, it is not required to machine a pressure control passage for permitting the high-pressure refrigerant gas within the accumulator to escape to decrease the pressure within the same. Further, the pressure control passage has a still larger cross-sectional area, and hence further excellent response of the capacity control valve device is obtained.

The above and other objects, features and advantages of the present invention will become more apparent from the following detailed description taken in conjunction with accompanying drawings.

DETAILED DESCRIPTION OF THE PREFERRED EMBODIMENTS

The invention will now be described in detail with reference to drawings showing preferred embodiments thereof.

Figure 1:
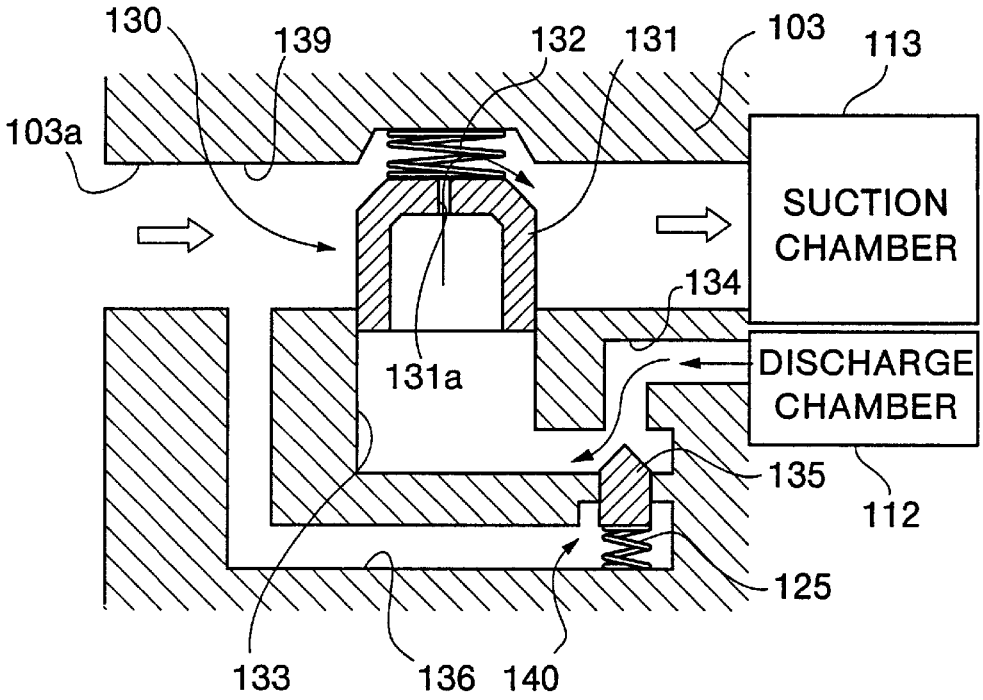
FIG.1 PRIOR ART
FIG. 1 is a conceptual view showing a conventional capacity control valve device of a variable capacity swash plate compressor in a state in which the valve opening of a main valve thereof is small.
Figure 2:
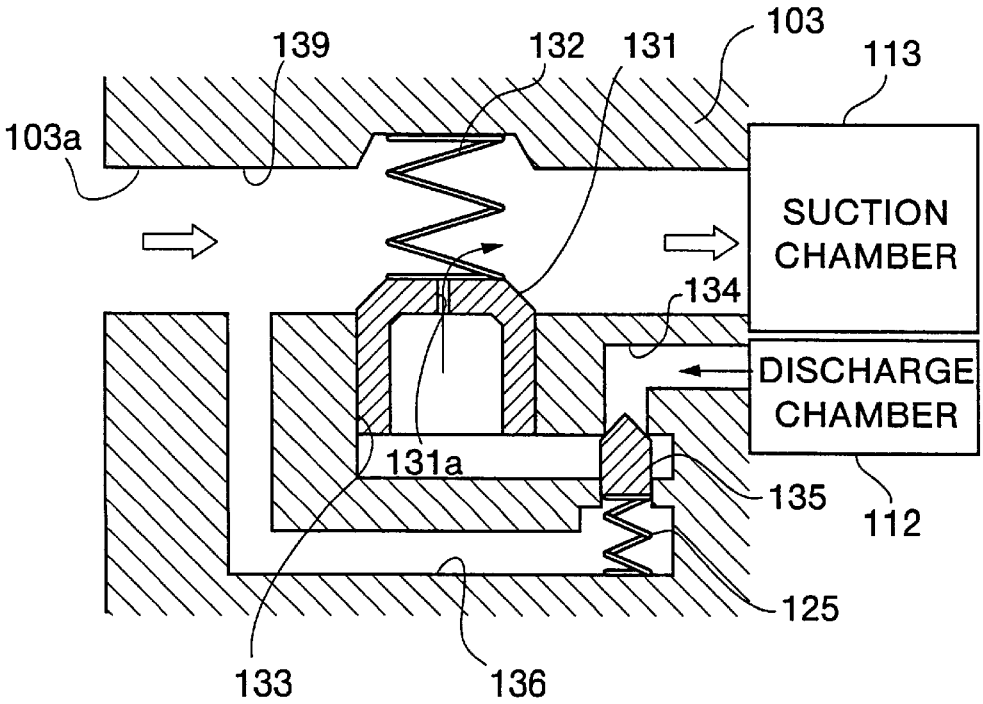
FIG.2 PRIOR ART
FIG. 2 is a conceptual view showing the conventional capacity control valve device in a state in which the valve opening of the main valve thereof is large.
Figure 3:
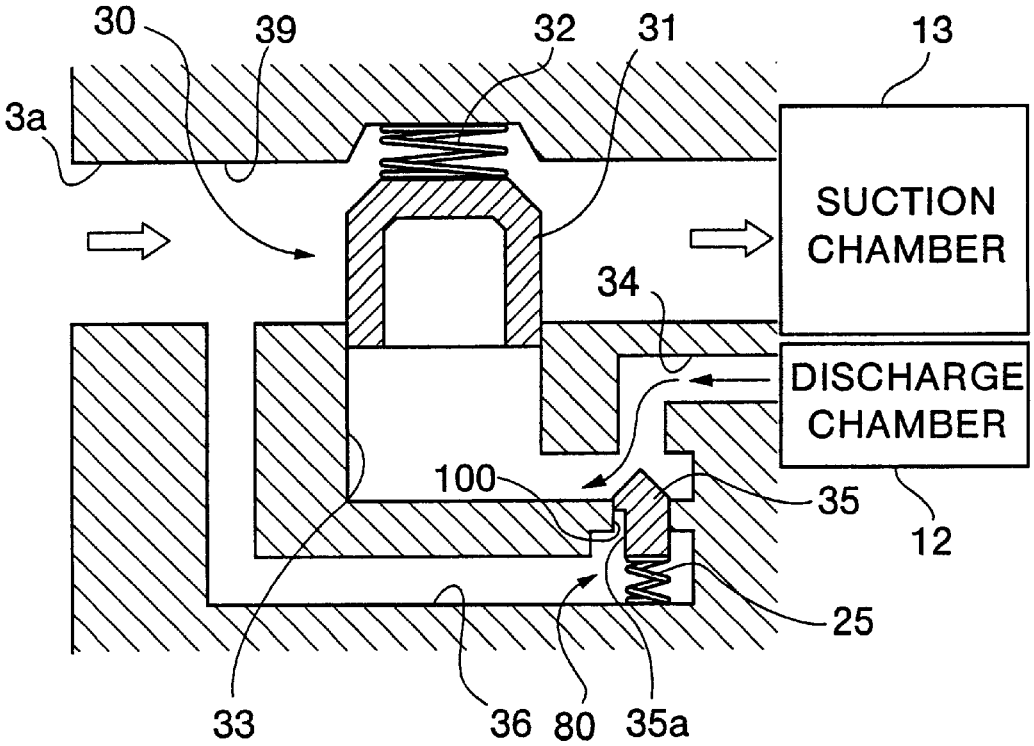
FIG. 3 is a conceptual view showing a capacity control valve device of a variable capacity swash plate compressor, according to a first embodiment of the invention, in a state in which the valve opening of a main valve thereof is small.
Figure 4:
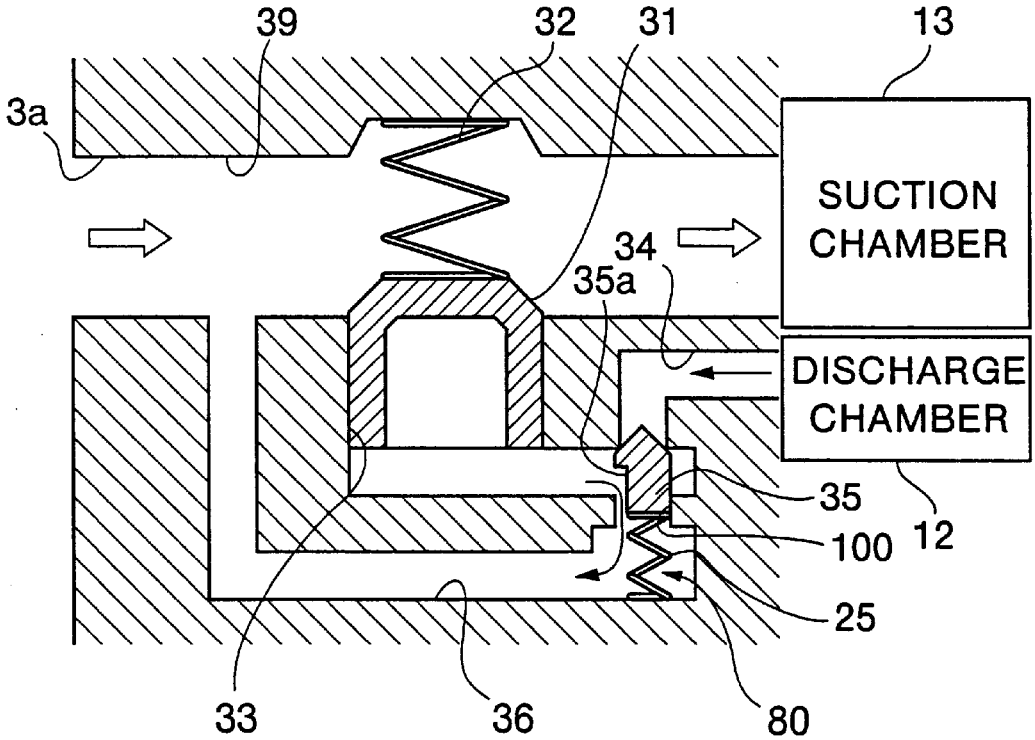
FIG. 4 is a conceptual view showing the capacity control valve device according to the first embodiment in a state in which the valve opening of the main valve thereof is large.
Figure 5:
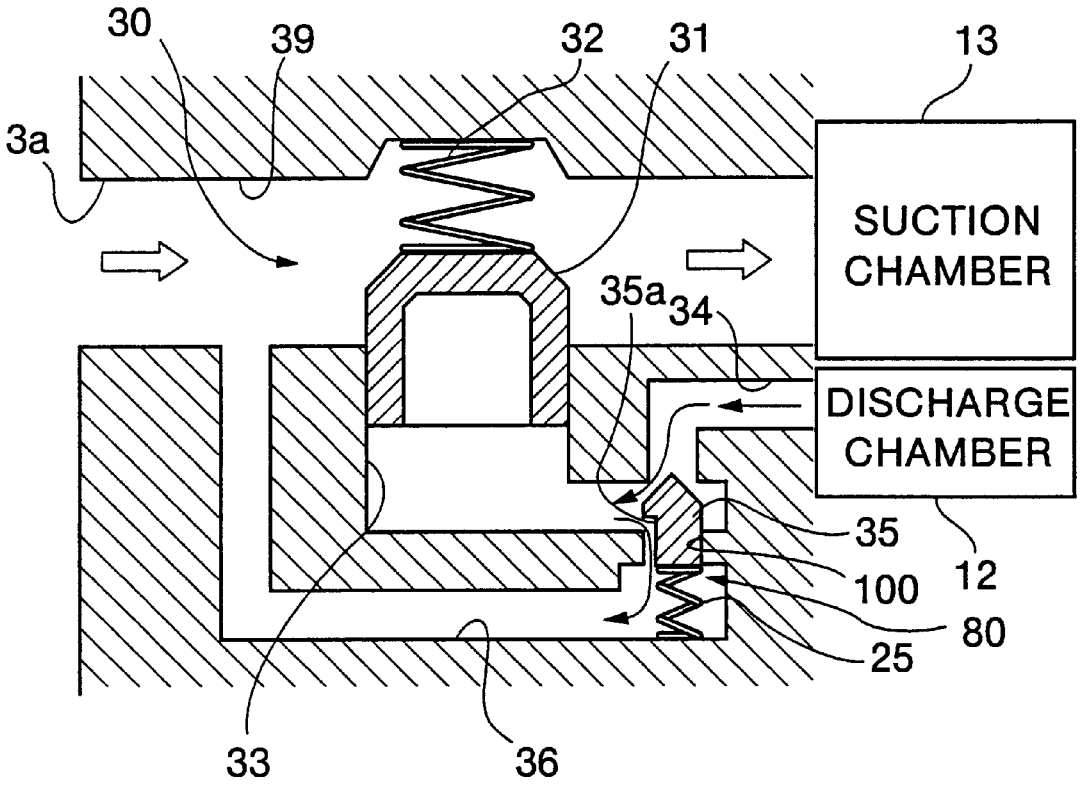
FIG. 5 is a conceptual view showing the capacity control valve device according to the first embodiment in a state in which the main valve thereof is half open.
Figure 6:
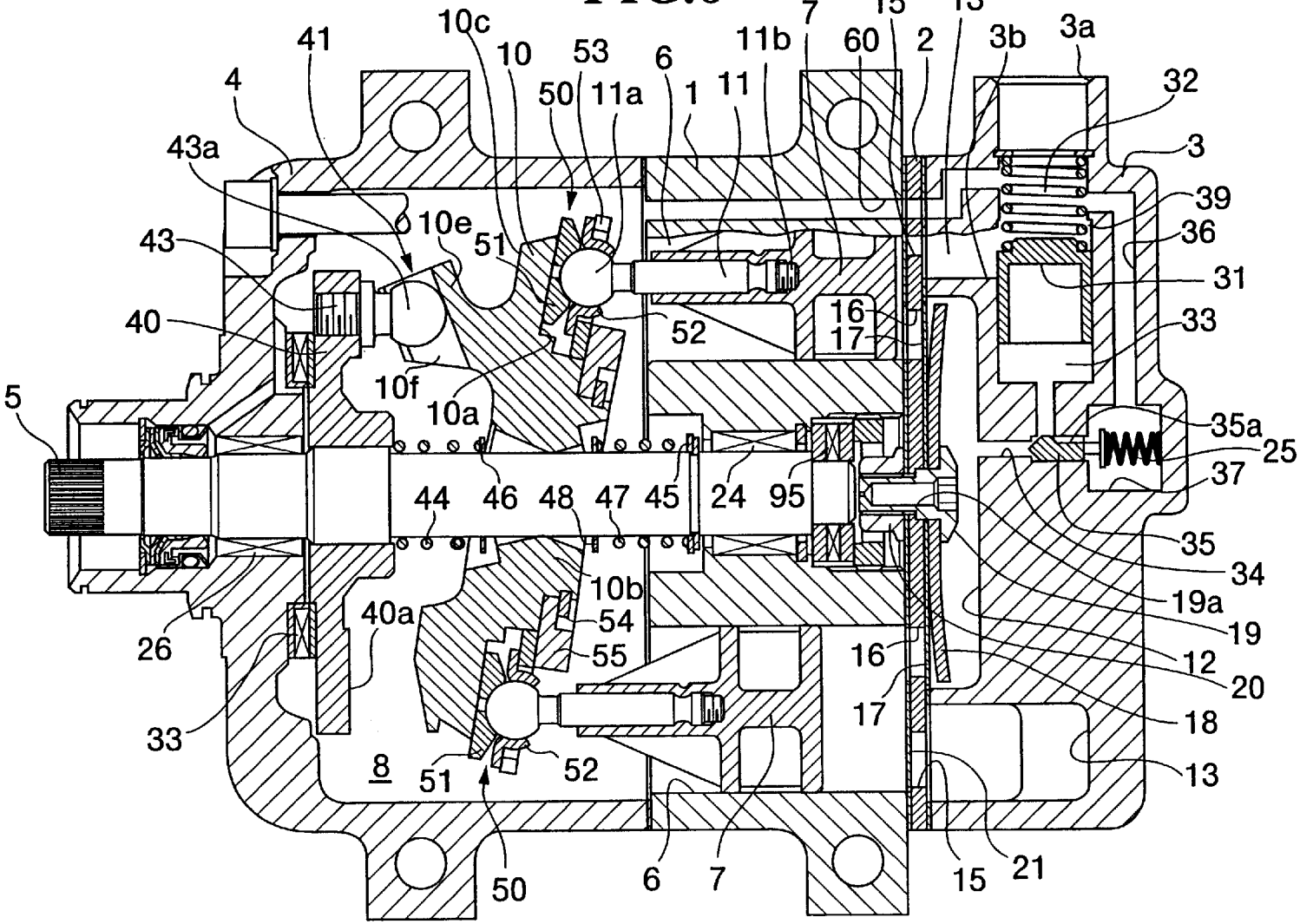
FIG. 6 is a longitudinal sectional view showing the whole arrangement of the variable capacity swash plate compressor incorporating the capacity control valve device according to the first embodiment.

Referring first to FIG. 6, there is shown the whole arrangement of a variable capacity swash plate compressor having a capacity control valve device according to a first embodiment of the invention. FIGS. 3 to 5 are conceptual views showing the capacity control valve device according to the present embodiment. FIG. 3 shows the capacity control valve device in a state in which valve opening of a main element thereof is small. FIG. 4 shows the capacity control valve device in a state in which the valve opening of the main valve thereof is large. FIG. 5 shows the capacity control valve device in a state in which the main valve thereof is half open. It should be noted that FIGS. 3 to 5 are conceptual views illustrating parts and elements essential to the construction of the capacity control valve device of the present embodiment but that a configuration of the capacity control valve device shown therein is not identical to one shown in FIG. 6. Needless to say, however, it is possible to employ a variation of the capacity control valve device designed similarly to the configuration illustrated in FIGS. 3 to 5.

The variable capacity swash plate compressor has a cylinder block 1 having one end thereof secured to a rear head 3 via a valve plate 2 and the other end thereof secured to a front head 4. The cylinder block 1 has a plurality of cylinder bores 6 formed therethrough at predetermined circumferentially-spaced intervals around a shaft 5 extending therethrough. Each cylinder bore 6 has a piston 7 slidably received therein.

Within the front head 4, there is formed a crank case 8. The crank case 8 has a swash plate 10 received therein. The swash plate 10 is slidably and tiltably fitted on the shaft 5. A shoe 50 for slidably supporting one end 11*a*, spherical in shape, of a corresponding one of connecting rods 11 is retained on a sliding surface 10*a* of the swash plate 10 by a retainer 53. The retainer 53 is mounted on a boss 10*b* of the swash plate 10 in a manner supported by a lock plate 55 fixed to the boss 10*b* by a stopper 54. The connecting rod 11 has the other end 11*b* thereof connected to the piston 7.

The shoe 50 is comprised of a shoe body 51 for slidably supporting a front-side surface of the one end 11*a* of the connecting rod 11 and a washer 52 for slidably supporting or retaining a rear-side surface of the one end 11*a* of the same.

Within the rear head 3, there are formed a discharge chamber 12 and a suction chamber 13 surrounding the discharge chamber 12. Further, the rear head 3 has a suction port 3*a* communicated with an evaporator, not shown, and a refrigerant inlet passage 39 formed therein communicating between the suction port 3*a* and the suction chamber 13. A capacity control valve device is provided within the rear head 3 for controlling differential pressure between pressure in the suction port 3*a* and pressure within the suction chamber 13.

The capacity control valve device is comprised of a main valve 30 having a valve element 31 arranged at an intermediate portion of the refrigerant inlet passage 39 and a spring (first urging member) 32 for urging the valve element 31 of the main valve 30 in a valve-opening direction, an accumulator 33 for accumulating high-pressure refrigerant gas to build up pressure therein for urging the valve element 31 of the main valve 30 in a valve-closing direction, a high-pressure passage 34 for introducing high-pressure refrigerant gas from the discharge chamber 12 into the accumulator 33, and a pilot valve (e.g. a spool valve) 80 arranged at an intermediate portion of the high-pressure passage 34 for controlling a flow rate of the refrigerant gas flowing into the accumulator 33 in dependence on the pressure in the suction port 3*a*. The pilot valve 80 is comprised of a valve element 35 and a spring (second urging member) 25 for urging the valve element 35 of the pilot valve 80 in a valve-closing direction.

The valve element 35 of the pilot valve 80 has an indentation (pressure control passage) 35*a* formed on a peripheral surface thereof in a manner extending in a direction of movement of the valve element 35. According to the present embodiment, not the valve element 31 of the main valve 30 but the valve element 35 of the pilot valve 80 is formed with the indentation 35*a* which serves as a pressure control passage, so that the indentation 35*a* can be designed such that it has a larger cross-sectional area than that of the pressure control passage 131*a* of the valve element 131 of the prior art described hereinbefore.

In a manner extending between the suction port 3*a* and the intermediate portion of the high-pressure passage 34 at which the pilot valve is arranged, there is formed a pilot passage 36 having a spring-accommodating chamber 37 formed at a location intermediate thereof for accommodating the coiled spring 25. The valve element 35 of the pilot valve 80 is slidably fitted in a through hole 100 formed through a wall separating the high-pressure passage 34 and the pilot passage 36 from each other, i.e. at an end of the pilot passage 34. The suction port 3*a* and the crank case 8 are always communicated with each other via a passage 60.

The valve plate 2 is formed with refrigerant outlet ports 16 for respectively connecting the cylinder bores 6 with the discharge chamber 12 and refrigerant inlet ports 15 for respectively connecting the cylinder bores 6 with the suction chamber 13. The refrigerant outlet ports 16 and the refrigerant inlet ports 15 are arranged at predetermined circumferentially-spaced intervals around the shaft 5, respectively. Each refrigerant outlet port 16 is opened and closed by a discharge valve 17. The discharge valve 17 is fixed to the valve plate 2 on the rear head side by a bolt 19 and nut 20 together with a valve stopper 18.

On the other hand, each refrigerant inlet port 15 is opened and closed by a suction valve 21 arranged between the valve plate 2 and the cylinder block 1. The bolt 19 has a guide hole 19*a* formed therethrough for guiding high-pressure refrigerant gas from the discharge chamber 12 to a radial bearing 24 and a thrust bearing 95.

The radial bearing 24 and the thrust bearing 95 support a rear-side end of the shaft 5, while a radial bearing 26 rotatably supports a front-side end of the shaft 5.

The shaft 5 has a thrust flange 40 rigidly fitted on a front-side portion thereof for transmitting torque of the shaft 5 to the swash plate 10. The thrust flange 40 is supported on an inner wall of the front head 4 by a thrust bearing 33. The thrust flange 40 and the swash plate 10 are connected with each other via a linkage 41. The swash plate 10 is tiltable with respect to a plane perpendicular to the shaft 5.

On the shaft 5 are fitted coiled springs 44 and 47 between the thrust flange 40 and a stopper 46 arranged on the shaft 5 and between stoppers 45 and 48 both arranged on the shaft 5, respectively.

The linkage 41 is comprised of a bracket 10*e* formed on a front-side surface 10*c* of the swash plate 10, a linear guide slot 10*f* formed through the bracket 10*e*, and a rod 43 screwed on a swash plate side surface 40*a* of the thrust flange 40. A longitudinal axis of the guide slot 10*f* is tilted through a predetermined angle with respect to the front-side surface 10*c*. A spherical portion 43*a* of the rod 43 is slidably engaged with the guide slot 10*f*.

Next, the operation of the variable capacity swash plate compressor incorporating the capacity control valve device according to the present embodiment will be described.

Torque of an engine, not shown, installed on an automotive vehicle is transmitted to the shaft 5. Torque of the shaft 5 is transmitted from the thrust flange 40 to the swash plate 10 via the linkage 41 to cause rotation of the swash plate 10.

The rotation of the swash plate 10 causes relative rotation of the shoe 50 on the sliding surface (rear-side surface) 10*a* of the swash plate 10 with respect to the swash plate 10, whereby the torque transmitted from the swash plate 10 is converted into reciprocating motion of the piston 7. When the piston 7 reciprocates within the cylinder bore 6, the volume of space (compression chamber) within the cylinder bore 6 changes. As a result, suction, compression and delivery of refrigerant gas are carried out sequentially, and high-pressure refrigerant gas is discharged in an amount corresponding to an inclination of the swash plate 10. During a suction stroke, the suction valve 21 opens, and low-pressure refrigerant gas is drawn from the suction chamber 13 into the compression chamber within the cylinder bore 6. During a discharge stroke, the discharge valve 17 opens and high-pressure refrigerant gas is delivered from the compression chamber to the discharge chamber 12.

When thermal load on the compressor decreases, the pressure in the suction port 3*a* decreases, whereby a force of the pressure of refrigerant gas in the refrigerant inlet passage 39 for urging the valve element 31 of the main valve 30 downward as viewed in FIG. 6, i.e. in the valve-opening direction decreases, and at the same time the pilot valve 80 opens, as shown in FIG. 3, to permit the high-pressure refrigerant gas to flow into the accumulator 33 from the discharge chamber 12 via the high-pressure passage 34. Since the valve element 31 of the main valve 30 is not formed with the pressure control passage, the pressure within the accumulator 33 builds up promptly. Therefore, the valve element 31 of the main valve 30 is lifted, i.e. moved in the valve-closing direction instantaneously to decrease the valve opening of the main valve 30 (i.e. the valve opening of the capacity control valve device). That is, excellent response of the capacity control valve device is obtained. As a result, passage resistance (resistance of the refrigerant inlet passage 39 to the flow of refrigerant gas therethrough) increases, whereby the pressure within the suction chamber 13 becomes lower than that in the suction port 3*a*, which reduces pressures within the refrigerant inlet port 15 and the pressure within the compression chambers downstream of the suction chamber 13. Pressure within the crank case 8 is maintained equal to that in the suction port 3*a* by the passage 60. Therefore, the difference in the pressure of the refrigerant gas within the crank case 8*a* acting on a front-side end face of the piston 7 in the suction stroke and the pressure of the refrigerant gas drawn into the compression chamber, which acts on a rear-side end face of the piston 7 in the suction stroke, increases, so that a portion of the swash plate 10 corresponding to the piston 7 in the suction stroke (the lower one of two shown in FIG. 6) is urged toward the rear side. As a result, the inclination of the swash plate 10 becomes smaller, which decreases the stroke of the piston 7 to thereby reduce the delivery quantity or capacity of the compressor.

On the other hand, when the thermal load on the compressor increase, the pressure in the suction port 3*a* rises to increase the force urging the valve element 31 of the main valve 30 in the valve-opening direction, i.e. downward as viewed in FIG. 4, and the force urging the pilot valve 80 in the valve-closing direction, i.e. upward as viewed in the same. As a result, as shown in the figure, the pilot valve 80 closes to cut off the flow of the high-pressure refrigerant gas into the accumulator 33. At this time, the accumulator 33 is communicated with the pilot passage 36 via the indentation 35*a* formed on the valve element 35 of the pilot valve 80, so that the high-pressure refrigerant gas within the accumulator 33 escapes to the suction port 3*a* via the indentation 35*a* and the pilot passage 36. The cross-sectional area of the indentation 35*a*, which serves as the pressure control passage, is larger than that of the pressure control passage 131*a* formed through the valve element 131 of the prior art. Therefore, the pressure within the accumulator 33 drops instantaneously to move the valve element 31 of the main valve 30 in the valve-opening direction, i.e. downward as viewed in FIG. 4, whereby the valve opening of the main valve 30 (i.e. the valve opening of the capacity control valve device) is increased. As a result, the passage resistance of the refrigerant inlet passage 39 decreases, and the pressure within the suction chamber 13 becomes equal to that in the suction port 3*a*. Compared with a low thermal load condition of the compressor, the difference in the pressure of the refrigerant gas within the crank case 8 acting on the front-side end face of the piston 7 in the suction stroke and the pressure of the refrigerant gas drawn into the compression chamber, which acts on the rear-side end face of the piston 7 in the suction stroke, becomes smaller, so that a portion of the swash plate 10 corresponding to the piston 7 in the suction stroke is urged toward the front side. As a result, the inclination of the swash plate 10 becomes larger. Thus, the stroke of the piston 7 is increased to increase the delivery quantity or capacity of the compressor.

Further, when the pressure in the suction port 3*a* is moderate, the valve opening of the pilot valve 80 is held in a state of equilibrium in which $Pd \times Sd = Pe \times Se + Fp$ holds, as shown in FIG. 5. In this case, the high-pressure refrigerant gas introduced into the accumulator 33 escapes via the indentation 35*a* of the pilot valve 80 to the low-pressure side (i.e. the pilot passage 36 and the suction port 3*a*), so that the valve element 31 of the main valve 30 is held in a state of equilibrium in which $Pe \times St + Ft = Pd \times Sc$ holds (where St: pressure-receiving area of the valve element 31 of the main valve 30 on the Pe side, Ft: urging force of the spring 32, and Se: pressure-receiving area of the valve element 31 of the main valve 30 on the Pd side).

According to this capacity control valve device of the first embodiment, when the pressure in the suction port 3*a* decreases to open the pilot valve 80, the valve element 31 of the main valve 30 is promptly moved in the valve-closing direction to decrease the valve opening of the main valve 30, while when the pressure in the suction port 3*a* rises to close the pilot valve 80, the valve element 31 of the main valve 30 is promptly moved in the valve-opening direction to increase the valve opening of the main valve 30. Thus, excellent response of the valve element 31 of the main valve 30 is obtained.

Figure 7:
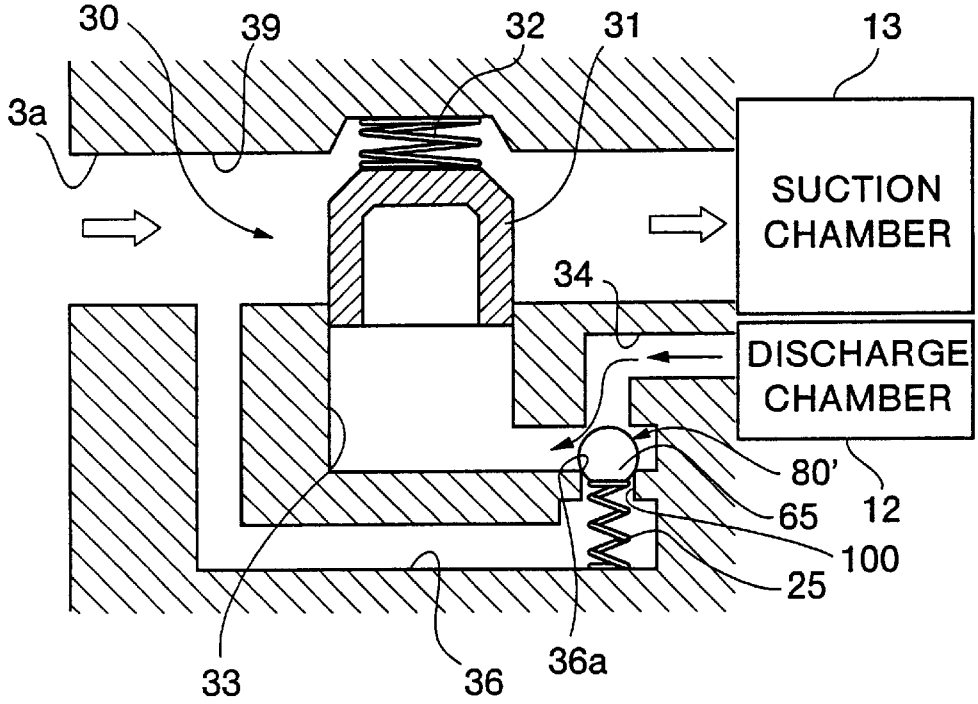
FIG. 7 is a conceptual view showing a capacity control valve device according to a second embodiment of the invention in a state in which the valve opening of a main valve thereof is small.
Figure 8:
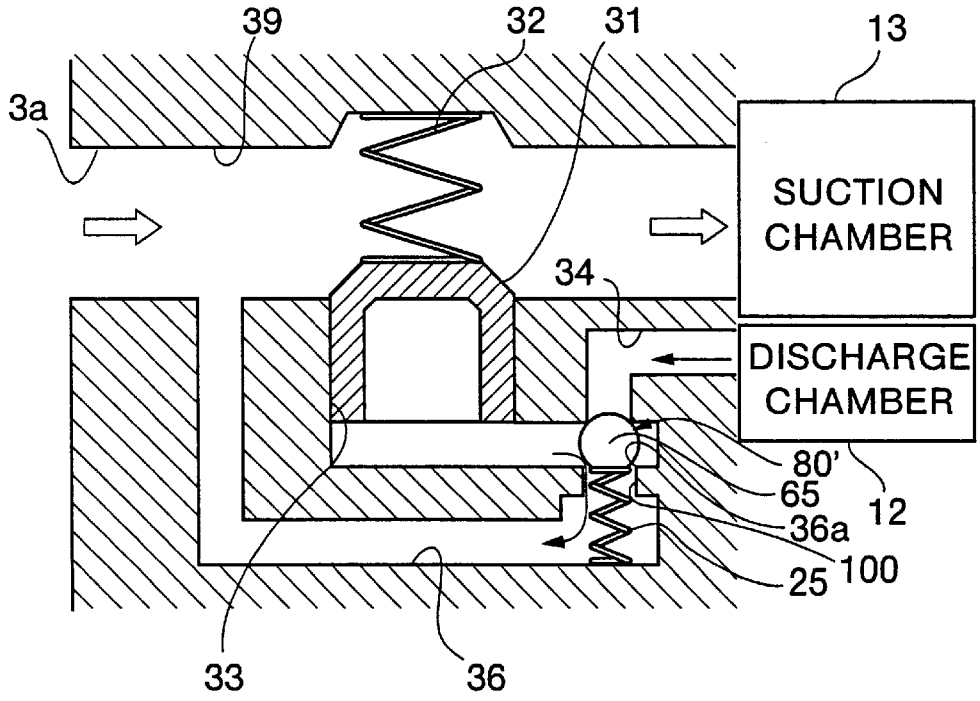
FIG. 8 is a conceptual view showing the capacity control valve device according to the second embodiment in a state in which the valve opening of the main valve thereof is large.

FIGS. 7 and 8 are conceptual views showing a capacity control valve device of a variable capacity swash plate compressor according to a second embodiment of the invention. FIG. 7 shows the capacity control valve device in a state in which the valve opening of the main valve is small, and FIG. 8 shows the capacity control valve device in a state in which the valve opening of the main valve is large. Component parts and elements corresponding to those of the first embodiment are indicated by identical reference numerals, and description thereof is omitted.

The second embodiment is distinguished from the first embodiment, in which a spool valve is used for the pilot valve 80 and the pressure control passage 35*a* is formed thereon, in that a ball valve 80' which is comprised of a valve element 65 having a spherical shape and a spring 25, is used as the pilot valve, as shown in FIG. 7. The valve element 65 is seated on a valve seat 36*a* formed in a high-pressure side opening of the through hole 100.

In the present embodiment, when the pressure in the suction port 3*a* decreases, force for urging the valve element 31 of the main valve 30 in the valve-opening direction decreases, and at the same time the ball valve 80' opens, as shown in FIG. 7, to permit high-pressure refrigerant gas to flow into the accumulator 33 from the discharge chamber 12 via the high-pressure passage 34.

On the other hand, when the pressure in the suction port 3*a* rises, the force for urging the valve element 31 of the main valve 30 in the valve-opening direction increases, and at the same time the force for urging the ball valve 80' in the valve-closing direction increases so that the ball valve 80' closes, as shown in FIG. 8. to cut off the flow of the high-pressure refrigerant gas into the accumulator 33. When the ball valve 80' as the pilot valve closes, i.e. the valve element 65 of the ball valve 80' is moved in the valve-closing direction, a gap is formed between the valve element 65 and the valve seat 36*a* to open a pressure control passage formed by the through hole 100. Thus, the high-pressure refrigerant gas within the accumulator 33 escapes to the suction port 3*a* through the gap, the through hole 100, and the pilot passage 36.

The capacity control valve device according to the second embodiment provides the same effects as obtained by the device according to the first embodiment.

Although in the above embodiments, description is made of cases in which the invention is applied to a variable capacity swash plate compressor, this is not limitative, but the invention may be applied to every kind of piston type compressor in which its capacity is controlled by changing inclination of a swash plate therein. Further, an externally-controlled actuator may be used as the capacity control valve device.

What is claimed is:

1. In a capacity control valve device for a variable capacity swash plate compressor including at least one piston, a suction port, a suction chamber, and a refrigerant inlet passage communicating said suction port with said suction chamber, in which each of said at least one piston has its stroke changed to control delivery quantity of said compressor, said capacity control valve device being arranged at an intermediate portion of said refrigerant inlet passage, for controlling differential pressure between pressure in said suction port and pressure within said suction chamber, said capacity control valve device including a valve element, a first urging member for urging said valve element in a valve-opening direction, an accumulator for accumulating high-pressure refrigerant gas having higher pressure than pressure within said suction chamber to build up pressure therein for urging said valve element in a valve-closing direction, a high-pressure passage for introducing said high-pressure refrigerant gas into said accumulator, and a pilot valve arranged at an intermediate portion of said high-pressure passage for controlling a flow rate of said high-pressure refrigerant gas into said accumulator in dependence on said pressure in said suction port, said pilot valve having a valve element, and a second urging member for urging said valve element of said pilot valve in said valve-closing direction, the improvement comprising a pressure control passage opened by said pilot valve for permitting said high-pressure refrigerant gas accumulated within said accumulator to escape to decrease said pressure within said accumulator, when said pilot valve operates in a valve-closing direction.

2. A capacity control valve device according to claim 1, wherein said valve element of said pilot valve has an indentation formed on a peripheral surface thereof in a manner extending in a direction of movement of said valve element of said pilot valve, said pressure control passage being formed by said indentation.

3. A capacity control valve device according to claim 1, including a pilot passage communicating with said suction port, said pilot valve being arranged in a through hole formed through a wall separating said pilot passage from said high-pressure passage, and wherein said pressure control passage opened by said pilot valve when said valve element of said pilot valve is moved in said valve-closing direction causes communication between said pilot passage and a portion of said high-pressure passage on said accumulator side with respect to said pilot valve.

4. A capacity control valve device according to claim 3, wherein said second urging member is a spring interposed between said valve element of said pilot valve and a portion of said pilot passage, for urging said valve element of said pilot valve in said valve-closing direction.

5. A capacity control valve device according to claim 2, wherein said pilot valve is formed by a spool valve.

6. A capacity control valve device according to claim 3, wherein said pilot valve is formed by a ball valve, said ball valve having a spherical valve element, said pressure control passage being formed by said through hole which is opened by movement of said spherical valve element in said valve-closing direction.

* * * * *